US008602500B1

(12) United States Patent
Warren

(10) Patent No.: US 8,602,500 B1
(45) Date of Patent: Dec. 10, 2013

(54) REPEATEDLY ASSEMBLEABLE AND DISASSEMBLEABLE CHAIR

(76) Inventor: Bruce Arthur Warren, Lake Jackson, TX (US)

( * ) Notice: Subject to any disclaimer, the term of this patent is extended or adjusted under 35 U.S.C. 154(b) by 241 days.

(21) Appl. No.: 12/688,579

(22) Filed: Jan. 15, 2010

Related U.S. Application Data

(60) Provisional application No. 61/144,888, filed on Jan. 15, 2009.

(51) Int. Cl.
*A47C 7/00* (2006.01)

(52) U.S. Cl.
USPC ..... 297/440.12; 297/440.14

(58) Field of Classification Search
USPC ..... 297/440.12, 440.14, 440.1
See application file for complete search history.

(56) References Cited

U.S. PATENT DOCUMENTS 3,331,634 A * 7/1967 Harrison, Jr. ..... 297/440.12
4,340,251 A * 7/1982 Geoffroy-Dechaume ..... 297/440.12
4,358,498 A * 11/1982 Chavannes ..... 428/108
4,385,782 A * 5/1983 Clark, Jr. ..... 297/440.12
4,648,658 A * 3/1987 Calco ..... 297/440.12
4,712,837 A * 12/1987 Swilley ..... 297/440.13
4,875,737 A * 10/1989 Cardenas ..... 297/440.12
6,161,901 A * 12/2000 Avner ..... 297/440.12
7,744,160 B2 * 6/2010 Stolarov ..... 297/440.12

* cited by examiner

*Primary Examiner* — Sarah B McPartlin
(74) *Attorney, Agent, or Firm* — Michael D. Eisenberg

(57) ABSTRACT

A chair, including a flat seat bottom, having a surface area for accommodating a user; a base member having at least one protrusion, the protrusion being designed for traversing a perforation on the seat bottom, thereby joining the base member to the bottom of the seat bottom, and the base member being designed for supporting the weight of the seat bottom and the user; and a back support member, designed for being joined to the section of the protrusion located above the seat bottom, and for being leaned upon by the user. The base member is made of a single sheet, and is designed for being set into a predefined weight bearing configuration suitable for supporting the weight of the user. The base member is designed for being unfolded into a single layer sheet or folded into a multi layer sheet, following a disassembling of the chair. The chair is repeatedly assemblable and disassemblable.

18 Claims, 10 Drawing Sheets

REPEATEDLY ASSEMBLEABLE AND DISASSEMBLEABLE CHAIR

CROSS-REFERENCES TO RELATED APPLICATIONS

This application claims priority from U.S. Provisional Application Ser. No. 61/144,888 filed on Jan. 15, 2009, which is hereby incorporated herein by reference in its entirety.

TECHNICAL FIELD

The present invention, in some embodiments thereof, relates to chairs, and more particularly, to assemblable and disassemblable chairs.

BACKGROUND OF THE INVENTION

Many persons attend events for which it would be desirable to have a portable chair. Such events include visits to the beach or sporting events. Many people consider it too cumbersome to carry a portable chair from their home to these events. Thus, there is a need for a chair which is sufficiently lightweight and portable that people would take it to such events.

Even if a lightweight and portable chair exists, many people do not wish to be bothered by the extra effort to carry the chair away after the event terminates. Thus, there is a need to provide a foldable chair so constructed that its manufacture and cost is sufficiently low that it can be discarded or otherwise disposed of after one or a few uses.

There are a number of portable stools or seats available on the market, but few chairs. The portable seats typically lack back rests. There is thus a need for a portable chair having a back rest.

A number of collapsible chairs are available in the prior art, but the assembling these chairs requires many steps, a deviation from which may cause the chair to be assembled in a wrong or unwanted fashion. There is therefore a need for an easily assemblable chair.

Furthermore, many assemblable chairs which may be used again are not disassemblable. These chairs, in their assembled configuration, occupy much space, and may not be comfortably carried or stored, after having been assembled. There is therefore a need for an assemblable chair designed to be disassembled and set into a space saving configuration.

BRIEF SUMMARY OF EMBODIMENTS OF THE INVENTION

The present invention relates to a chair, which is repeatedly assemblable and disassemblable, and having components which are designed for being set a space saving configuration, after the chair is disassembled.

An aspect of some embodiments to the present invention relates to a chair, which includes a flat seat bottom, having a surface area for accommodating a user; a base member having at least one protrusion, the protrusion being designed for traversing a perforation on the seat bottom, thereby joining the base member to the bottom of the seat bottom, and the base member being designed for supporting the weight of the seat bottom and the user; and a back support member, designed for being joined to the section of the protrusion located above the seat bottom, and for being leaned upon by the user. The base member is made of a single sheet, and is designed for being set into a predefined weight bearing configuration suitable for supporting the weight of the user. The base member is designed for being unfolded into a single layer sheet or folded into a multi layer sheet, following a disassembling of the chair. The chair is repeatedly assemblable and disassemblable.

Optionally, the perforation of the seat bottom is designed for constraining the protrusion of the base member into a predefined shape, the predefined shape affecting the geometry of the base member, such that the base member is constrained into the predefined weight bearing folded configuration thereof by being joined to the seat bottom.

In a variant, the base member has a plurality of protrusions, and the seat bottom has a plurality of perforations, each perforation is designed for being traversed by only one protrusion, and for holding tightly the protrusion, and the perforations are set in a predefined pattern, such that the base member is constrained into the predefined weight bearing configuration, once each protrusion has traversed the corresponding perforation.

In another variant, the base member is designed for being set into one of two weight bearing configurations: folded along five vertical lines, such that in the base member's weight bearing configuration, a cross section of the base member along a horizontal plane is shaped like a W, with two flaps at the extremities of the W, reaching toward the middle of the W; and folded along seven vertical lines, such that in the base member's weight bearing configuration, a cross section of the base member along a horizontal plane is shaped like a W with two smaller V-shaped flaps, each flap folded within one of the halves of the W.

In a yet another variant, the base member includes three protrusions, and the seat bottom has three perforations, each perforation configured for being traversed by only one of the three protrusions and for holding tightly the protrusion the perforation is traversed by. In this manner, the base member is constrained into the predefined weight bearing configuration by being joined to the seat bottom.

In a further variant, the base member is initially a prefolded multilayer sheet, is designed for being released into a shape that approximates the predefined weight bearing configuration, and is designed for assuming the predefined weight bearing configuration by being joined to the seat bottom, after having been released.

In yet a further variant, the first protrusion is centered about the second fold from the rightmost edge of the expanded base member, the second protrusion is centered about the fourth fold from the rightmost edge of the unfolded base member, and the third protrusion is centered about the sixth fold from the rightmost edge of the unfolded base member. In this manner, the protrusions rise from the three wedges on the back side of the base member in the folded configuration thereof, and the protrusions are V-shaped when the base member is in the folded configuration thereof, with the wedges of the V's pointing away from the center of the chair.

Optionally, the perforations of the base member are also V-shaped to accommodate the protrusions and set the dihedral angle of the protrusions.

In a variant, the horizontal length of the protrusions diminishes as the vertical height of the protrusions rises.

In another variant, the back support member includes: a bottom portion, having at least one aperture, for being traversed by one of the protrusions; a middle portion, designed for being folded along a first line at a first angle with respect to the bottom portion, and for being leaned on by the user; and a top portion, having at least one hole for being traversed by one of the protrusions, the top portion being designed for being folded along a second line at a second angle with respect to the middle portion, and for securing the back support member to at least one of the protrusions. The back support member is made of a single sheet and is designed for being set into a predetermined folded arrangement. The back support member is designed for being unfolded into a single layer sheet or folded into a multi layer sheet, following a disassembling of the chair.

In yet another variant, the cross sectional size of the aperture is smaller than the maximal cross sectional size of the middle protrusion, and larger than the minimal cross sectional size of the middle protrusion. The size of the aperture is chosen so that the back support member is designed for being slipped down the middle protrusion only up to a predefined location which is at a predefined distance from the seat bottom, further slippage being hindered by the larger cross sectional size of the middle protrusion below the predefined location.

In a further variant, the aperture is one of V-shaped and triangular.

In yet a further variant, the bottom portion of the back support member has a circular orifice near the aperture, the circular orifice being designed for encircling a beverage cup placed on the seat bottom.

Optionally, the base member, seat bottom, and back support member are made of a corrugated material.

In a variant, the corrugated material is one of corrugated plastic and corrugated cardboard.

In another variant, the base member, seat bottom, and back support member are cut from a single board.

In yet another variant, the base member includes at least one vertical wire, for increasing a weight bearing capacity of the base member.

In a further variant, the wire is one of a steel wire and a plastic wire.

In yet another variant, the above chair weighs about 3 pounds.

Optionally, the above chair is designed for supporting a seated user weighing less than 300 pounds.

Another aspect of the present invention relates to a method for assembling a chair, including: providing a seat bottom, a base member, and a back support member; setting the base member into a weight bearing configuration, suitable for supporting the weight of a user; joining the base member to the seat bottom so that the seat bottom is positioned on top of a weight supporting section of the base member, by traversing an orifice of the seat bottom via a protrusion included in the base member; and joining the back support member to a section of the protrusion located above the seat bottom.

Optionally, the weight bearing configuration of the base member is one of the following: folded along five vertical lines, such that in the weight bearing configuration, a cross section of the base member along a horizontal plane is shaped like a W, with two flaps at the extremities of the W, reaching toward the middle of the W; and folded along seven vertical lines, such that in the weight bearing configuration of the base member, a cross section of the base member along a horizontal plane is shaped like a W with two smaller V-shaped flaps, each flap folded within one of the larger V's forming the W.

In a variant, the providing includes providing a flat base member, and the setting includes folding the base member into one of: the weight bearing configuration, and a shape approximating the weight bearing configuration.

In another variant, the providing includes providing the base member as a prefolded multilayer sheet, and the setting includes releasing the base member into one of the weight bearing configuration, and a shape approximating the weight bearing configuration.

In yet another variant the joining of the back support member to the protrusion includes: joining a bottom portion of the back support member to the protrusion, by traversing an aperture of the bottom portion via a section of the protrusion above the seat bottom; folding the back support member along a first predetermined line, so that a middle portion of the back support member is at a first angle with respect to the bottom portion; folding the back support member along a second predetermined line, so that a top portion of the back support member is at a second angle with respect to the middle portion; and securing the top portion of the back support member to the protrusion, by traversing a hole of the top portion via the protrusion.

In a further variant, the seat bottom, the base member, and the back support member are cut from a single flat board, and the providing includes separating the seat bottom, the base member, and the back support member from the flat board.

In yet a further variant, the base member includes a plurality of protrusions, and the seat bottom has one orifice for each protrusion of the base member.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

Figure 1A:
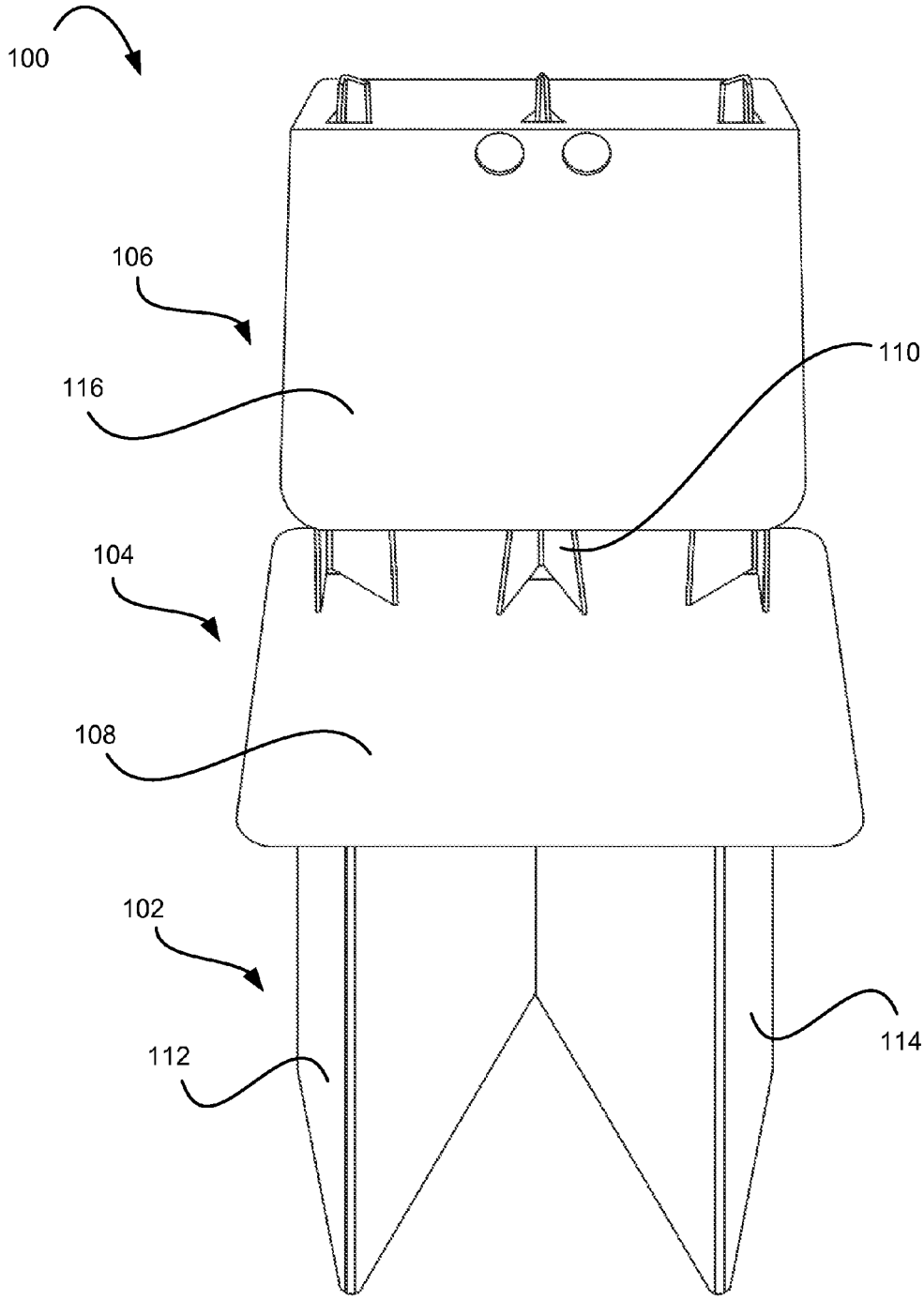
FIGS. 1*a*-1*b* are perspective drawings illustrating an assembled chair, according to some embodiments of the present invention.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

The present invention, in some embodiments thereof, relates to chairs, and more particularly, to assemblable and disassemblable chairs.

An aspect of some embodiments of the present invention relates to a chair which includes a seat bottom, a base member, and a back support member, which are designed for being joined together and form the chair. In a variant, the base member is a prefolded multi layer sheet, and is designed for being released into a predetermined weight bearing configuration or into a shape approximating the weight bearing configuration. In another variant, the base member is a flat sheet and is designed for being folded along predetermined lines into a predetermined weight bearing configuration or into a shape approximating the predetermined weight bearing configuration. Optionally, the back support member is also made of a flat sheet and is designed for being folded along predetermined lines into a predetermined folded arrangement. After the chair is disassembled, the base member, and optionally the back support member, is designed for being unfolded into a single layer sheet or folded into a multi layer sheet, in order to decrease the space required to store the chair.

The base member is the lowermost member of the chair, and includes at least one protrusion designed for traversing the seat bottom through a perforation, thereby joining the base member and the seat bottom. The back support member is designed for being joined to the section of the protrusion which is located above the seat bottom.

According to an exemplary embodiment of the present invention, the base member is designed for being set into one of two weight bearing configurations. In the first configuration, the base member folds along five vertical lines, so that in the base member's weight bearing configuration, a cross section of the base member along a horizontal plane is shaped like a W, with two flaps at the extremities of the W, reaching toward the middle of the W. In the second configuration, the base member folds along seven vertical lines, such that in the weight bearing configuration, a cross section of the base member along a horizontal plane is shaped like a W with two smaller V-shaped flaps, each flap folded within one of the larger V's forming the W.

In a variant, the base member and back support member are prefolded along the above mentioned lines, restricting the releasing of the base member into a shape approximating the predefined weight bearing configuration and the releasing of the back support member into an arrangement approximating the predefined arrangement. In another variant, the base member includes three protrusions and the seat bottom includes three perforations shaped to tightly hold the protrusions. In this manner, the base member is constrained into the preset weight bearing folded configuration by being joined to the seat bottom. In a further variant, the back support member includes one or more apertures configured for being traversed by the section of the protrusion located above the seat bottom. In yet another variant, the horizontal length of the protrusions diminishes as the vertical height of the protrusions rises, and the size of the aperture on the back support member is predefined in order to set the back support member at a predefined distance from the seat bottom. All the above restrictions make the assembly of the chair easy to perform and prevent the user from assembling the chair incorrectly.

The above chair does not include fasteners that would join different members of the chair. The absence of fasteners, besides increasing the chair's ease of assembly, also increases the ease of the chair's disassembly.

In a variant, the chair weighs about 3 pounds and supports a seated user weighing about 300 pounds.

Optionally, the chair includes two flat seat bottoms designed to be stacked one above the other in the assembled chair, to increase the comfort of the chair.

Optionally, the base member, the seat bottom, and the back support member are cut from a single board. In an exemplary embodiment of the present invention, three base members, three seat bottoms, and three back support members are cut from a single 8 ft×8 ft board, to decrease material waste during production, thereby decreasing production cost.

Before explaining at least one embodiment of the invention in detail, it is to be understood that the invention is not necessarily limited in its application to the details of construction and the arrangement of the components and/or methods set forth in the following description and/or illustrated in the drawings. The invention is capable of other embodiments or of being practiced or carried out in various ways.

Figure 1B:
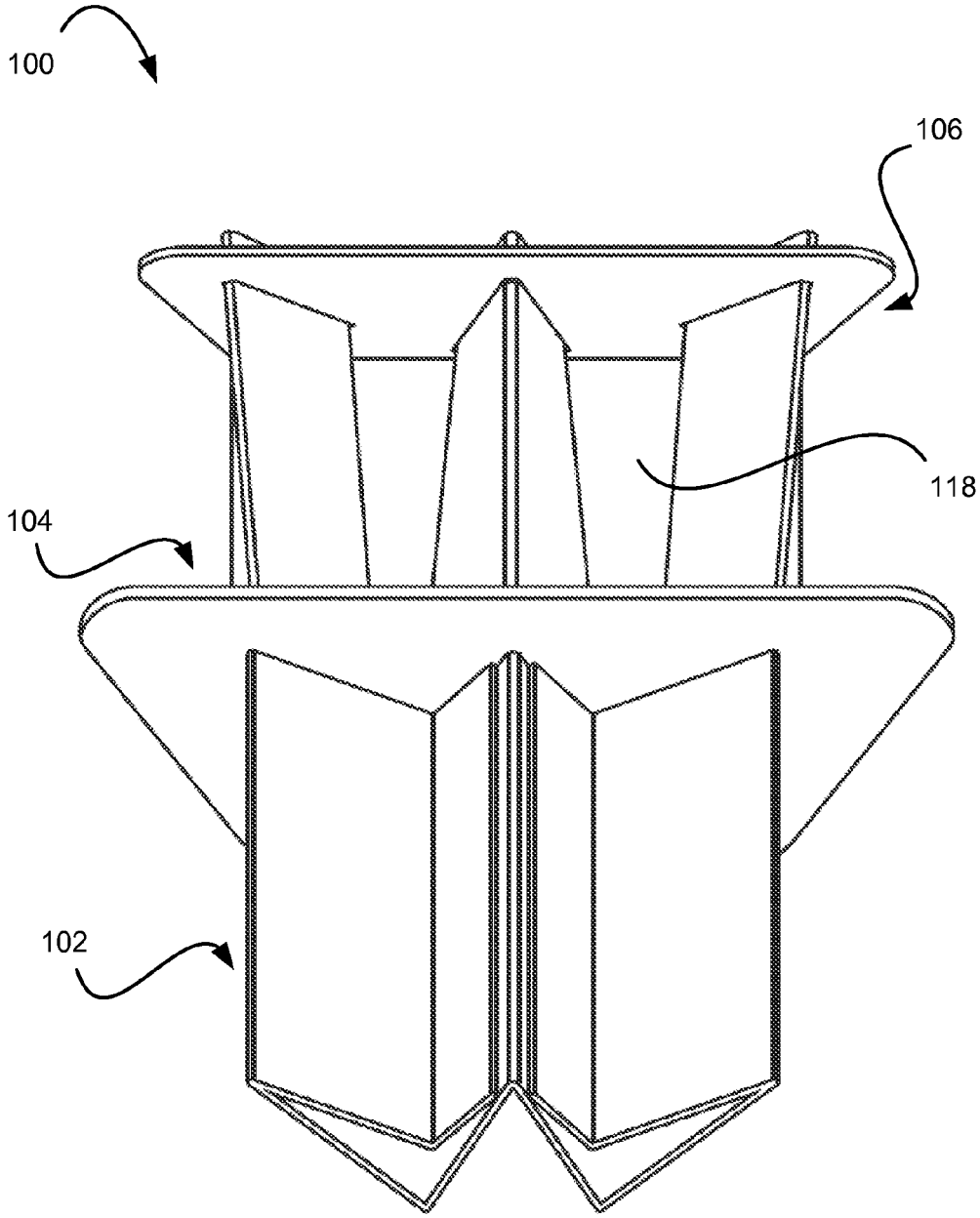

Referring now to the figures, FIGS. 1*a*-1*b* are perspective drawings illustrating an assembled chair 100, according to some embodiments of the present invention. FIG. 1*a* is a front-top view of the chair 100. FIG. 1*b* is a back-bottom view of the chair 100.

The chair 100 includes three elements: a base member 102, a seat bottom 104, and a back support member 106. The elements 102, 104, and 106 are fitted together, so that a user may sit on a surface area 108 of the seat bottom 104, and the weight of the user is supported by the base member 102. The back support member 106 is designed to be fitted on the base member 102, for being leaned upon by the user.

The base member 102 includes at least one protrusion 110, designed to traverse a perforation of the seat bottom 104. As the protrusion 110 traverses the perforation of the seat bottom 104, the base member 102 and the seat bottom 104 are joined. The back support element 106 is designed for being joined to a section of the protrusion 110 located above the seat bottom 102. According to some embodiments of the present invention, the back support member 106 is joined to the protrusion 110 of the seat bottom 102 by being folded and traversed by the protrusion 100, as described later in FIGS. 4*b*, 6*b*, 7*c*-7*d*. Optionally, the back support member 106 is joined to the protrusion 110 by other means, such as adhesive tape, for example.

The base member 102 is made of a single sheet. According to some embodiments of the present invention, the base member 102 is initially a flat sheet, and is designed to be folded along predetermined lines into a weight bearing configuration. In a variant, the base member 102 is initially a prefolded multilayer sheet, and is designed for being released into the predefined weight bearing configuration or into a shape that approximates the predefined weight bearing configuration. In this variant, the ease of assembly of the chair is increased, as the user does not need to fold the base member 102.

According to some embodiments of the present invention, the weight bearing configuration of the base member 102 viewed from top or bottom plane is shaped like a W with two smaller V-shaped flaps, each flap folded within one of the larger V's forming the W. The shape is clearly visible in FIGS. 1*b* and 2*b*.

According to some embodiments of the present invention, the protrusion of the base member includes at least one line about which the base member folds for being set into the predetermined weight bearing configuration. The perforation of the seat bottom is shaped in order to constrain the protrusion into a predefined shape, thereby affecting the geometry of the base member. The base member is therefore constrained into the predefined weight bearing folded configuration thereof by being joined to the seat bottom.

According to some embodiments of the present invention, the base member has a plurality of protrusions, and the seat bottom has a plurality of perforations, each perforation designed for being traversed by only one protrusion, and for holding tightly the protrusion. The perforations are set in a predefined pattern, so that the base member is constrained into the predefined weight bearing configuration, once each protrusion has traversed the corresponding perforation. In this manner, the base member 102 may not expand or contract into a different configuration while being joined to the seat bottom 104.

Optionally, the base member 102 has three protrusions, and the seat bottom 104 had three perforations, each perforation designed for being traversed by only one of the three protrusions. Each perforation is further designed for holding tightly the protrusion the perforation is traversed by. In this manner, the base member 102 is constrained into the preset weight bearing configuration thereof by being joined to the seat bottom 104, and may not expand or contract into a different configuration while being joined to the seat bottom 104. This characteristic increases the ease of assembly of the chair 100, as the user does not need to set the base member 102 into the exact weight bearing configuration, and may set the base member 102 into a shape which approximates the predefined weight bearing configuration. The base member 102 will assume the predefined weight bearing configuration when the base member 102 is joined to the seat bottom 104.

Figure 2A:
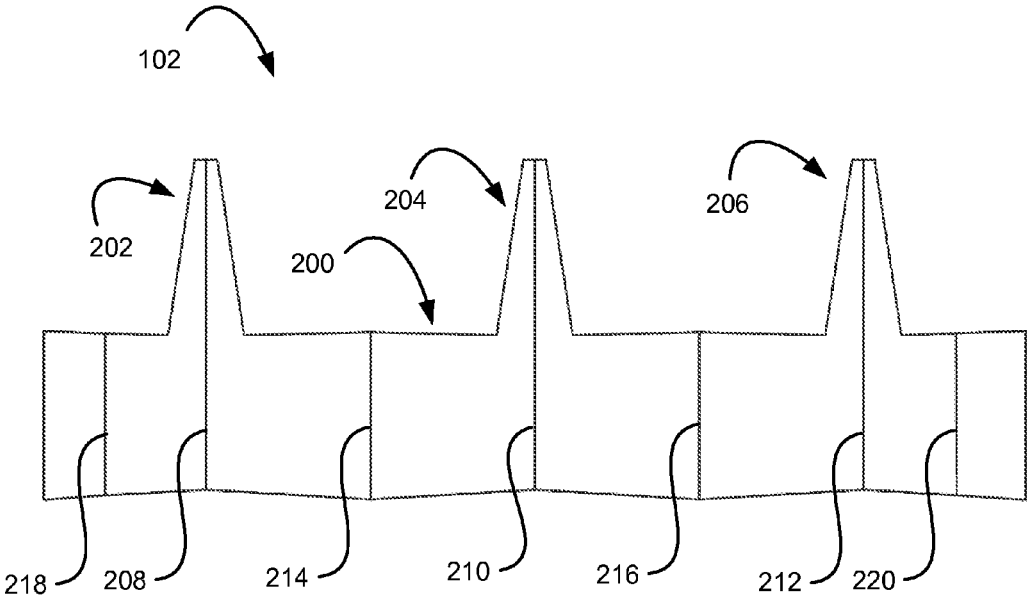
FIGS. 2*a*-2*c* are drawings illustrating a base member of the chair in an extended configuration thereof and in weight bearing configurations thereof, according to some embodiments of the present invention.
Figure 2B:
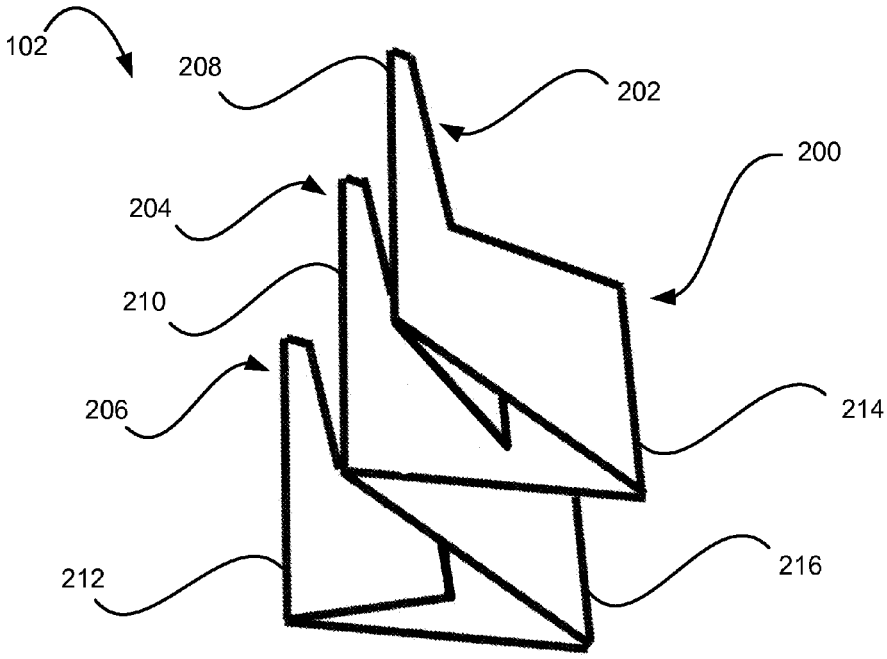
Figure 4A:
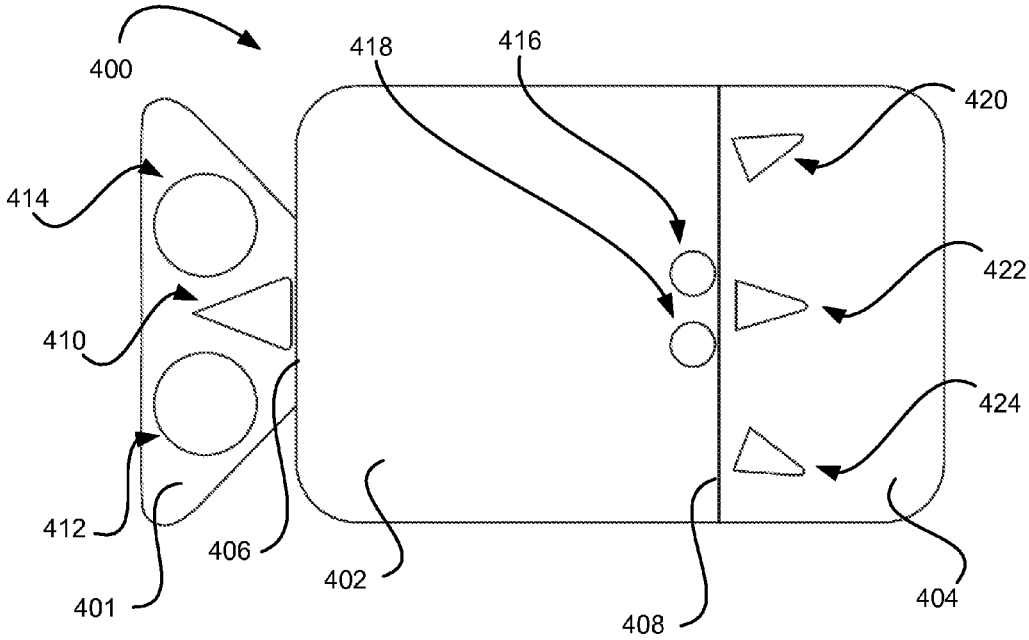
FIGS. 4*a*-4*b* are drawings illustrating a foldable back support member of the chair, in an extended arrangement thereof and in a folded arrangement thereof, according to some embodiments of the present invention.
Figure 4B:
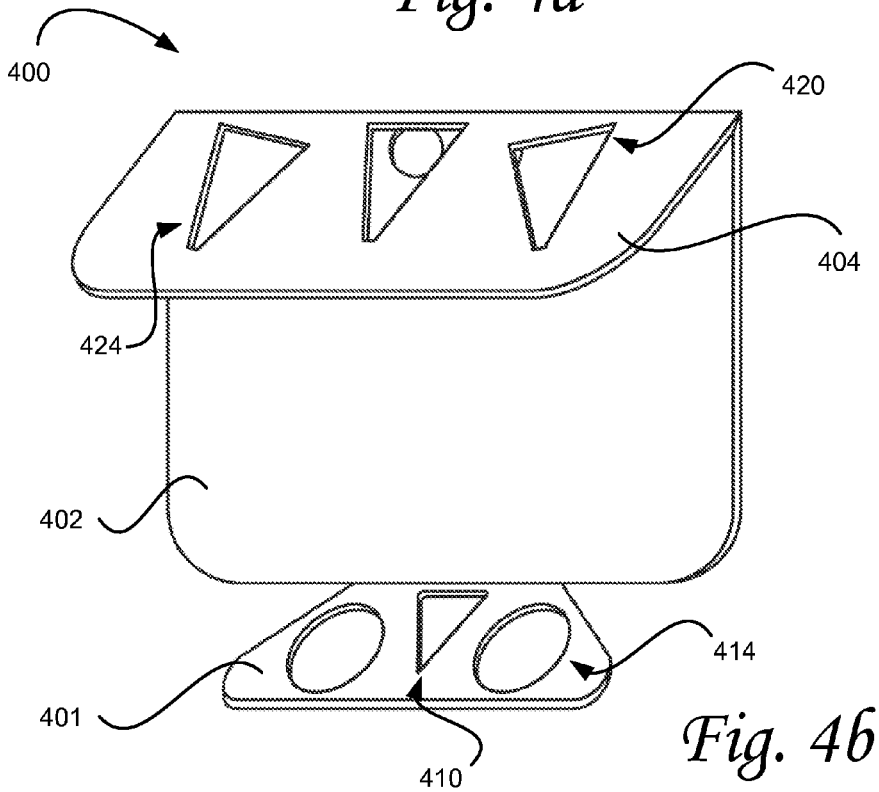

The chair 100 is repeatedly assemblable and disassemblable. The base member 102 is made of a flat sheet (as shown in FIGS. 2*a*-2*b*), and is designed for being set into the predefined weight bearing configuration. Furthermore, the base member 102 is designed for being unfolded into a single layer sheet or folded into a multi layer sheet, following a disassembling of the chair 100. The seat bottom 104 is flat. Optionally, the back support member 106 is also made of a flat sheet, and is designed for being folded into a preset arrangement (as shown in FIGS. 4*a*-4*b*). Furthermore, the back support member 106 is designed for being unfolded into a single layer sheet or folded into a multi layer sheet, following a disassembling of the chair 100. Therefore, the volume occupied by a disassembled chair is smaller than the volume occupied by an assembled chair. This allows the chair 100 to be carried and/or stored in a space saving mode. Therefore, a plurality of chairs like the chair 100 may be transported without the need for a large vehicle. Once the chairs are brought to the target location, they may be assembled.

According to some embodiments of the present invention, the chair 100 is made of lightweight material. The lightweight material may be, for example, corrugated plastic or corrugated paperboard. Corrugations on the base member 102 are optionally vertical, in order to handle compression loads created by the weight of the seated user. In such a configuration, the chair 100 is both light, and therefore easy to carry, and strong, and may therefore support a heavyset user. In an exemplary embodiment of the present invention, the chair 100 is made of corrugated paperboard, weighs about 3 lbs and is strong enough to support a seated user weighing about 300 lbs.

Corrugated cardboard is recyclable, and corrugated plastic may be chosen to be recyclable as well. Since the chair 100 is made out of a single material, the chair 100 is easily recyclable, as there is no need to separate different material from each other. Furthermore, both corrugated cardboard and corrugated plastic are cheap materials. Using the above materials to produce the chair 100 may reduce the price of the chair 100 enough for the user to deem the chair 100 disposable after one or several uses.

If the chair 100 is made of corrugated plastic, the chair 100 is sanitary, as the plastic does not absorb dirty substances, such as spilled drinks, for example, and the dirty substance are easily wiped off.

If the chair 100 is made of corrugated cardboard or corrugated plastic, the chair 100 is disposable, as the chair 100 may be easily incinerated. Therefore, the chair 100 may be used in hospitals and public shelters in times of mass illnesses.

The chair 100 includes at least five flat surfaces on which images, such as customized logos or writings, may be placed and be easily visible. These surfaces are: a first side surface 112 of the base member 102; a second side surface 114 of the base member 102; the surface area 108 of the seat bottom 104; a front surface 116 of the back supporting piece 106; and a back surface 118 of the back supporting piece 106. More images may be placed on other surfaces of the chair 100 as well. Optionally, the images are silk screened on the desired surface or surfaces of the chair 100. Alternatively stickers containing the images are attached to the desired surface or surfaces of the chair 100. The chair 100 may therefore also be used for advertising or for customizing an event, such as a concert, a wedding, or a convention.

Figure 2C:
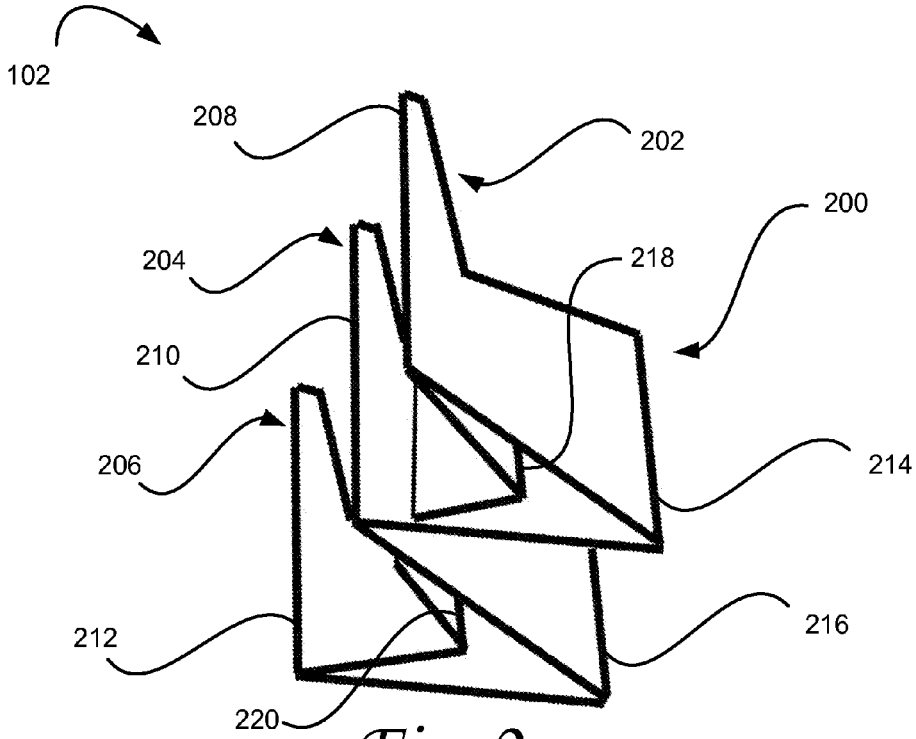

FIGS. 2*a*-2*c* are drawings illustrating a base member 102 of the chair 100 in an extended configuration thereof and in weight bearing configurations thereof, according to some embodiments of the present invention. FIG. 2*a* illustrates the base member 102 in an extended configuration. FIG. 2*b* illustrates the base member 102 in a first predefined weight bearing folded configuration. FIG. 2*c* illustrates the base member 102 in a second predefined weight bearing folded configuration.

When unfolded, the base member 102 is flat. The base member 102 has a weight supporting section 200 and at least one protrusion. The weight supporting section 200 is designed bear the weight of a user sitting on the chair 100. According to some embodiments of the present invention, the base member 102 includes three protrusions: a left protrusion 202, a middle protrusion 204, and a right protrusion 206.

Optionally, the base member 102 has five vertical grooves along which the base member 102 folds. In a variant, the lines 208, 210, and 212 are located in the middle of the protrusions 202, 204, and 206, respectively. In this manner, when the protrusions 202, 204, and 206 have V-shaped cross sections along a horizontal plane, with the wedges of the V's pointing away from the chair's center. The line 214 is located along the length of the base member 102 between the lines 208 and 210. The line 216 is located along the length of the base member 102 between the lines 210 and 212. Optionally the base member 102 has seven vertical lines along which the base member 102 folds: an additional line 218 is located between the line 208 and the left extremity of the base member 102, while a further additional line 220 is located between the line 212 and the right extremity of the base member 102.

The base member 102 folds along the lines 208, 210, and 212 in one direction, for example toward the user. The base member 102 then folds along the lines 214 and 216 in an opposite direction, for example away from the user. In this manner, a cross section of the base member 102 looks like the outline letter "W" with two flaps at the extremities of the "W", reaching toward the middle of the "W", as shown in FIG. 2*b*. When the base member 102 further folds along the lines 218 and 220, two small V shaped flaps tucking into the halves of the "W" are created, as shown in FIG. 2*c*.

The above weight bearing configurations provide four full depth panels to support the sitter's weight, and two or four half depth panels near the rear of the seat where the sitting user's weight is concentrated. This distributes the sitting user's weight over a large area, and increases the weight supportable by the base member 102. In an exemplary embodiment of the present invention, the base member 102 supports a seated user weighing less than 300 pounds.

According to some embodiments of the present invention, the horizontal length of the protrusions 202, 204, and 206 diminishes as the vertical height of the protrusions rises. This feature helps to set the height of the distance between the seat bottom 104 and the back support member 106, as will be discussed below in the description of FIGS. 4*a*-4*b*.

Optionally, the base member 102 includes at least one vertical wire, for increasing a weight bearing capacity of the base member 102. If the base member is made of corrugated material, such as corrugated plastic or corrugated cardboard, as described above, at least one vertical channel in the corrugated material is reinforced for greater weight bearing capacity by inserting one or more wires into the channel. In a variant, the wire is made of steel, for example tempered steel. In another variant, the wire is made of plastic. According to some embodiments of the present invention, the wire inserts are used on both sides of each vertical fold on the base member 102. The wires add little weight, and serve as stiffeners to keep the folded panel material from deflecting from the vertical, thus increasing a load bearing capacity of the corrugated material.

According to some embodiments of the present invention, the base member 102 is made of two separate halves. The first half is the section between the leftmost edge of the base member 102 and the central line 210. The second half is the section between the central line 210 and the rightmost edge of the base member 102. Optionally, when the chair is assembled, the first half and the second half are joined together at the line 210. This may be done, for example, by taping the two halves together. Having two separate halves allows the chair 100 to be produced using 4 ft×8 ft boards, which are standard and readily available, as discussed below in the description of FIG. 5.

Figure 3:
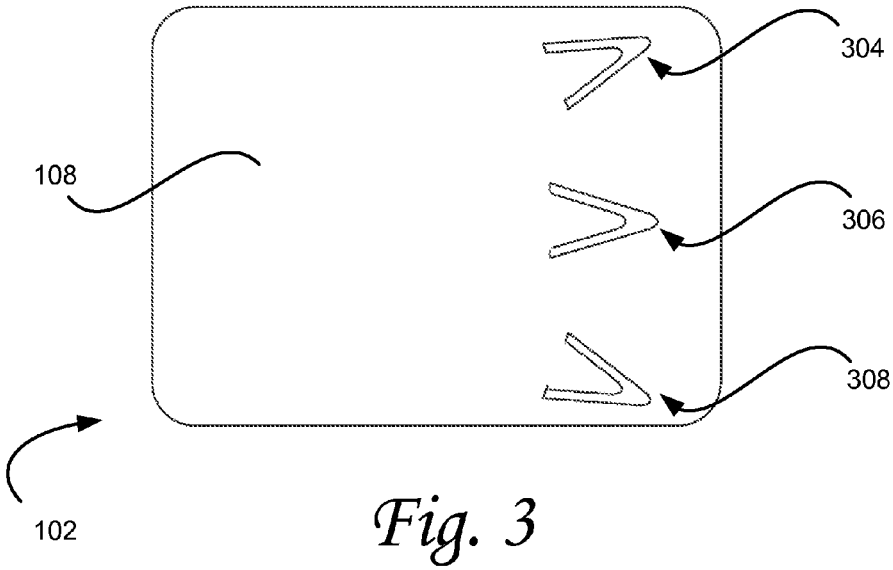
FIG. 3 is a drawing illustrating a flat seat bottom of the chair, according to some embodiments of the present invention.

FIG. 3 is a drawing illustrating a flat seat bottom 104, according to some embodiments of the present invention.

The seat bottom 104 is a flat sheet, which includes a sitting surface 108, designed to accommodate the posterior of the sitting user. The seat bottom 104 has a perforation 306, designed to be traversed by the protrusion of the base member 102. Optionally, the seat bottom has a number of perforations matching the number of protrusions of the base member 102. For example, it may have three perforations, 304, 306, and 308, designed to be traversed by the protrusions 202, 204, and 206, respectively.

According to some embodiments of the present invention, the shapes of the perforations 304, 306, and 308 determine the cross sectional shapes of the protrusions 202, 204, and 206, respectively. In an exemplary embodiment, the perforations 304, 306, and 308, and the protrusions 202, 204, and 206 are V shaped. Each perforation tightly holds the corresponding protrusion, and determines the angle of the V's wedge of the corresponding protrusion. In this manner, joining the seat bottom 104 to the base member 102 ensures that the base member 102 is folded according to predetermined angles, thereby constraining the base member to the predetermined weight bearing configuration. Optionally, the shape of the perforations 304, 306, and 308 holds of the protrusions 202, 204, and 206, respectively, such that the angles of the V wedges match predetermined values, chosen to increase the stiffness of the protrusions, so that the protrusion resist bending when the user leans on the chair 100.

Optionally, when the seat bottom 102 and the base member 102 are joined, the seat bottom 104 is designed for being placed on top of the weight supporting section 200 of the base member 102, so that the sitting surface 108 is parallel to a horizontal plane.

In alternative embodiments, the seat bottom 104 may be differently shaped.

According to some embodiments of the present invention, the chair 100 includes at least two seat bottoms, configured for being stacked one on top of the other, when the chair 100 is assembled. In this manner, the comfort of the chair 100, as the extra seat bottom is a further buffer between the user and the weight supporting section 200 of the base member 102, and distributes the weight of the user more evenly.

FIGS. 4*a*-4*b* are drawings illustrating a foldable back support member 400, according to some embodiments of the present invention. FIG. 4*a* shows the back support member 106 in an extended arrangement thereof. FIG. 4*b* shows the back support member 106 in a folded arrangement thereof. The foldable back support member 400 may be substituted to the back support member 106 described in FIGS. 1*a*-1*b*.

The back support member 400 is designed for being joined to at least one protrusion of the base member 102, and for being leaned upon by a user sitting on the chair 100.

The back support member 400 includes three portions: a bottom portion 401, a middle portion 402, and a top portion 404. The bottom portion 401 is separated from the middle portion 402 by a first line 406. The middle portion 402 is separated from the top portion 404 by a second line 408. The back support member is designed to be folded along the lines 406 and 408, so that the bottom portion 401 and the top portion 404 form predetermined angles (optionally of about 90 degrees) with the middle portion 402, and so that the bottom portion 401 and the top portion 404 are traversed by at least one of the protrusions of the base member 102. Following a disassembling of the chair, the back support member is designed for being unfolded into a single layer sheet or folded into a multi layer sheet, for space saving.

The bottom portion 401 is characterized by a middle aperture 410 designed to be traversed by the middle protrusion 204 of the base member 102. According to some embodiments of the present invention, the cross sectional size of the middle protrusion 204 decreases as the vertical height of the protrusion 204 rises, and the cross sectional size of the aperture 410 is smaller than the maximal cross sectional size of the middle protrusion 204, and larger than the minimal cross sectional size of the middle protrusion. The size of the aperture 410 is chosen so that the back support member 106 is configured for being slipped down the middle protrusion 204 only up to a predefined location, at a predefined distance from the seat bottom. Further slippage of the back support member down the middle protrusion 204 is hindered by the fact that below the predefined location, the cross section size of the middle protrusion 204 is larger than that cross sectional size of the aperture 410.

The aperture 410 may have any shape. Optionally, the shape of the aperture 410 matches the cross sectional shape of the middle protrusion 204. The aperture 410 may be, for example, V shaped or triangular.

According to some embodiments of the present invention, the bottom portion 401 is further characterized by at least one circular orifice, designed for encircling a beverage cup placed on the seat bottom. In FIGS. 4*a*-4*b*, two round orifices 412 and 414 are present, and located on each side of the middle aperture 410. The bottom portion 401 is set on above the seat bottom 104, a predetermined distance away from the seat bottom 104. Cups may be inserted in the round orifices 412 and 414, so that the bases of the cups are supported by the seat bottom 104, and the walls of the cups are encircled by the round orifices 412 and 414.

Optionally, the middle portion 402 has one or more carrying holes, like the carrying holes 416 and 418. The carrying holes are designed to facilitate the transportation of the assembled chair 100, by being traversed by a user's fingers.

The top portion 404 is designed for securing the back support member 106 to the protrusion, ensuring that the middle portion 402 is at the correct angle for being leaned upon by the user. The top portion 404 has at least one orifice designed for being traversed by at least one of the protrusions of the base member 102. Optionally, the top section is characterized by the orifices, 420, 422, and 424 designed for being traversed by the protrusions 202, 204, and 206, respectively.

Figure 5:
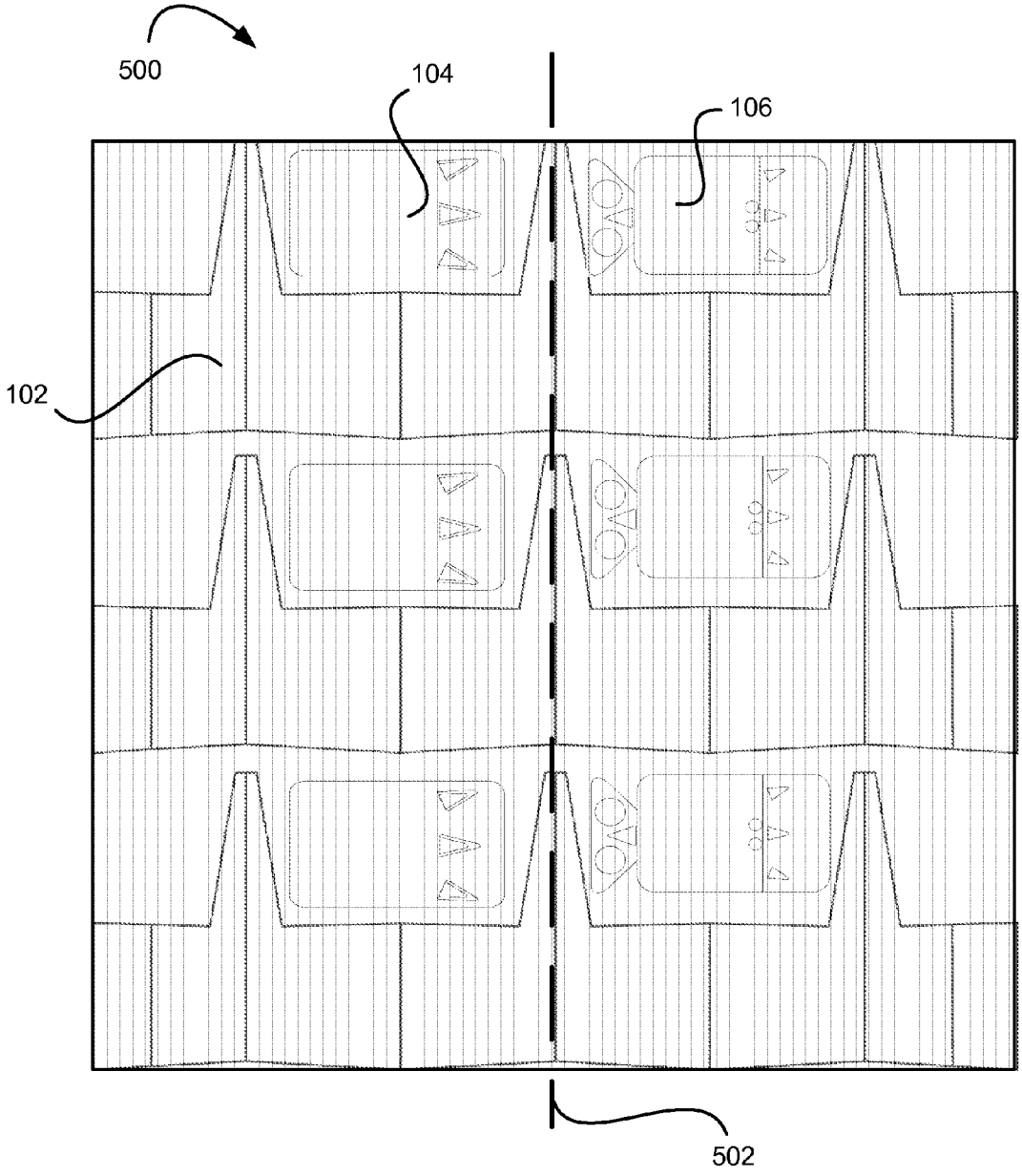
FIG. 5 is a drawing illustrating an exemplary flat board, from which chair elements are cut for the assembly of three chairs, according to some embodiments of the present invention.

FIG. 5 is a drawing illustrating an exemplary flat board 500, from which chair elements are cut for the assembly of three chairs, according to some embodiments of the present invention.

The flat board 500 is a standard 8 ft×8 ft board. On the board 500, shapes of the base member 102, the seat bottom 104, and the back support member 106 are shown, three times each. The chair elements are cut from the board according to a predefined pattern: three base members are one above the other; above each base member, between the leftmost protrusion and the middle protrusion, is a seat bottom; above each base member, between the middle protrusion and the rightmost protrusion is a back support member. According to some embodiments of the present invention, the flat board 500 is made of a corrugated material, such as corrugated cardboard of corrugated plastic, as mentioned above. In such case, the chair elements are cut from the board, so that the lines along which the chair elements are to be folded are parallel to the corrugation of the material. This makes the folding easier, and may increase the weight bearing capacity of the base member.

An 8 ft×8 ft board may be used to produce the elements needed for the assembly of three chairs similar of the chair 100. Alternatively, if 8 ft×8 ft boards are not available, two standard 4 ft×8 ft boards may be used, half of the pattern being cut from each 4 ft×8 ft board. In FIG. 5, the first half is on the left of the line 502, and the second half is on the right of the line 502. The base member 102 is split into two halves, which may be joined together, for example through adhesive tape, during the assembly of the chair 100, as mentioned above, in the description of FIGS. 2*a*-2*c*.

The predefined pattern described above may decrease waste material during the production of the chair 100, thereby decreasing the manufacturing cost of the chair 100.

The base member 102, the seat bottom 104, and the back support member 106 may be separated from the board in many ways. For example, the separation may be performed by die cutting, panel-routing with a carbide bit, laser cutting, or manual slicing with box cutters. Optionally, the pattern is printed on the board 500 prior to separating the base member 102, the seat bottom 104, and the back support member 106 from the board, in order to facilitate the separation, particularly, but not only, if the separation is performed manually.

Figure 6A:
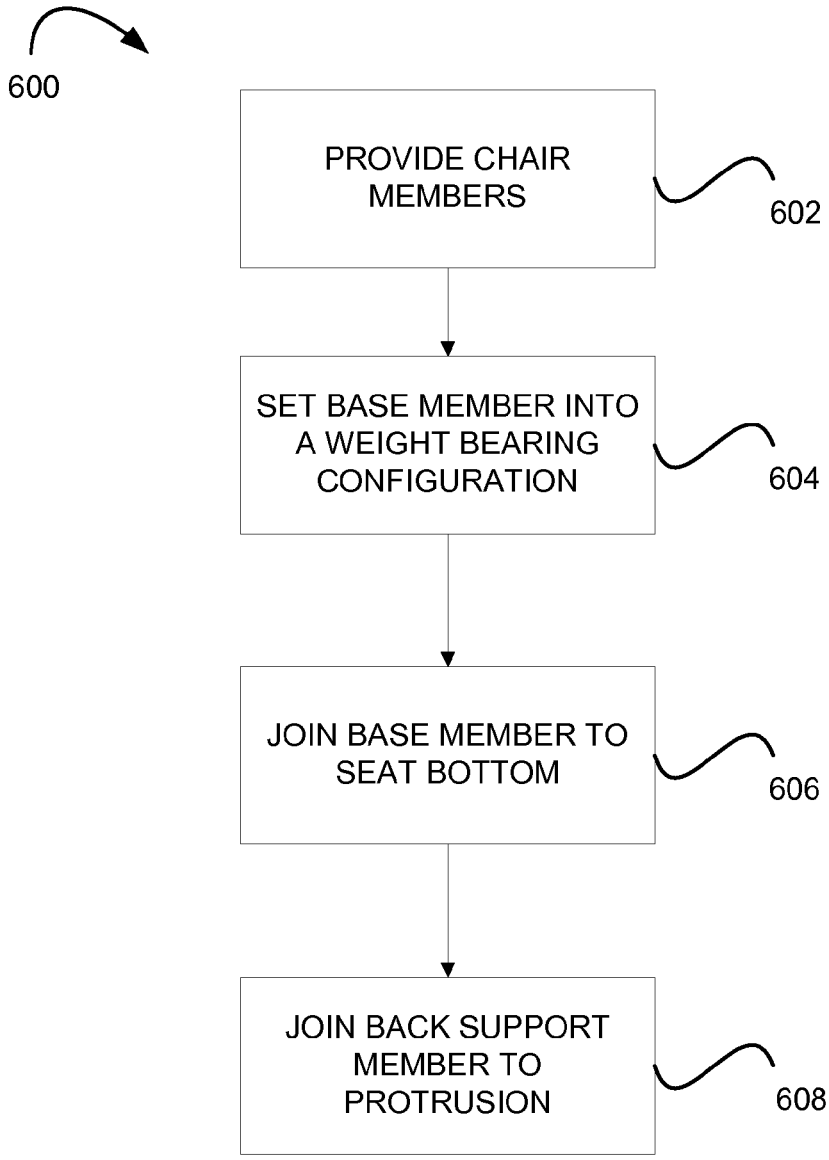
FIG. 6*a*-6*b* are flowcharts illustrating methods for assembling a chair, according to some embodiments of the present invention.
Figure 6B:
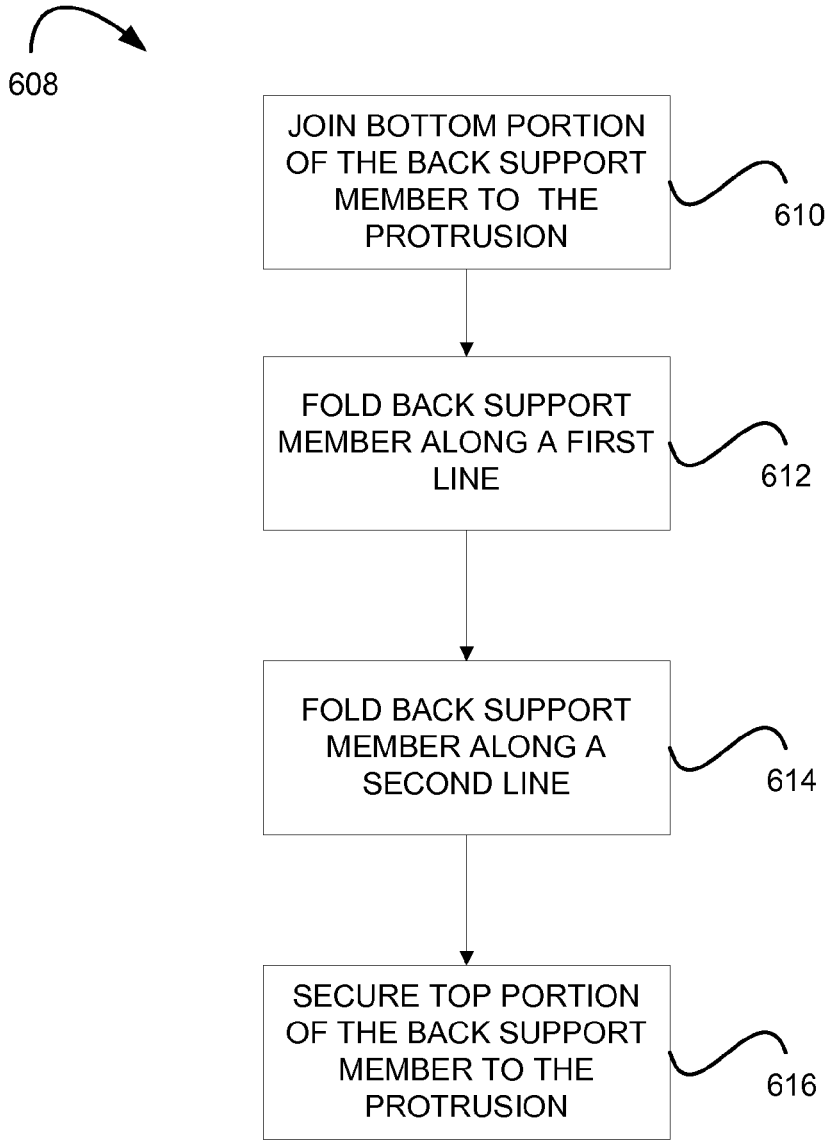

FIG. 6*a*-6*b* are flowcharts illustrating methods for assembling a chair, according to some embodiments of the present invention. FIG. 6*a* illustrates a 600 method for assembling a chair. FIG. 6*b* illustrates a method for joining a back support member to the chair.

In FIG. 6*a*, at 602, chair members are provided. The chair members include a base member, as described in FIGS. 1*a*-1*b* and FIGS. 2*a*-2*c*, a seat bottom, as described in FIGS. 1*a*-1*b* and FIG. 3, and a back support member, as described in FIGS. 1*a*-1*b* and FIGS. 4*a*-4*b*. In a variant, the base member is provided as a single layer sheet. In another variant, the base member is provided as prefolded multi layer sheet. Optionally the chair members are provided, by being separated from a single board, as described in FIG. 5.

At 604, the base member is set into a weight bearing configuration. If the base member is flat, setting the base member into the weight bearing configuration includes folding the base member along predetermined lines. If the base member is provided as a folded multi layer sheet, setting the base member into a weight bearing configuration includes releasing the base member. In a variant, the base is set into the weight bearing configuration. In another variant, the base member is set into a shape approximating the weight bearing configuration. The weight bearing configuration may be, for example, the configuration shown in FIG. 3*b*, or the configuration shown in FIG. 3*c*.

At 606, the seat bottom is joined to the base member, by traversing an orifice of the seat bottom via a protrusion included in the base member. Optionally, a multitude of protrusions are present, and each traverses an orifice on the base member. If at 604 the base member has been set into a shape approximating the predefined weight bearing configuration, joining the base member to the seat bottom constrains the base member into the weight bearing configuration, as explained above.

At 608, the back support member is joined to the section of the protrusion above the seat bottom. The joining may be accomplished, for example, by taping the back support member to the protrusion above the seat bottom.

In FIG. 6*b*, an exemplary embodiment of step 608 is illustrated, for a foldable back support member, as shown in FIGS. 4*a*-4*b*.

At 610, a bottom portion of the back support member is joined to the protrusion, by traversing an aperture of the bottom portion via a section of the protrusion above the seat bottom. Optionally, a plurality of apertures and a plurality of protrusions are present, and each aperture is traversed by a corresponding protrusion.

At 612, the back support member is folded along a first predetermined line, such as the line 406 of FIGS. 4*a*-4*b*, so that a middle portion of the back support member leans against the protrusion.

At 614, the back support member is folded along a second predetermined line, such as the line 408 of FIGS. 4*a*-4*b*, so that a top section of the back support member is at an angle with respect to the middle portion.

At 616, the top section of the back support member is secured to the protrusion, by traversing a hole of the top section via the protrusion. Optionally, a plurality of holes and a plurality of protrusions are present, and each aperture is traversed by a corresponding protrusion.

FIGS. 7*a*-7*d* are drawings illustrating the steps for assembling the chair shown in FIG. 6*a*-6*b*.

Figure 7A:
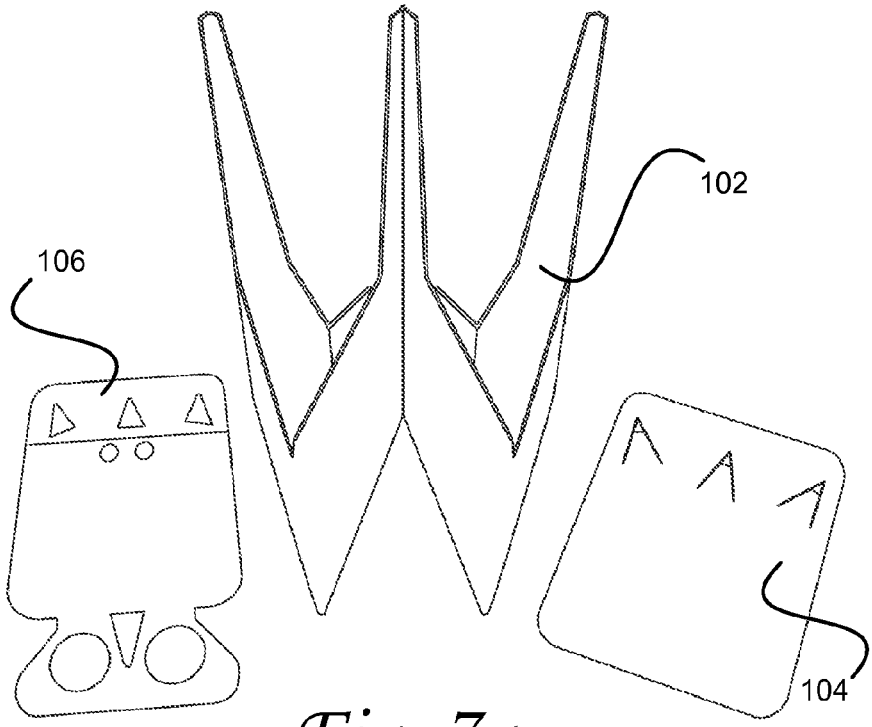
FIGS. 7*a*-7*d* are drawings illustrating the steps for assembling the chair shown in FIGS. 6*a*-6*b*.

FIG. 7*a* illustrates the steps 602 and 604 of the method 600. The base member 102, the seat bottom 104, and the back support member 106 of FIGS. 1*a*-1*b* are provided. Optionally, the foldable back support member 400 of FIGS. 4*a*-4*b* is provided. The base member 102 is set into a weight bearing configuration.

Figure 7B:
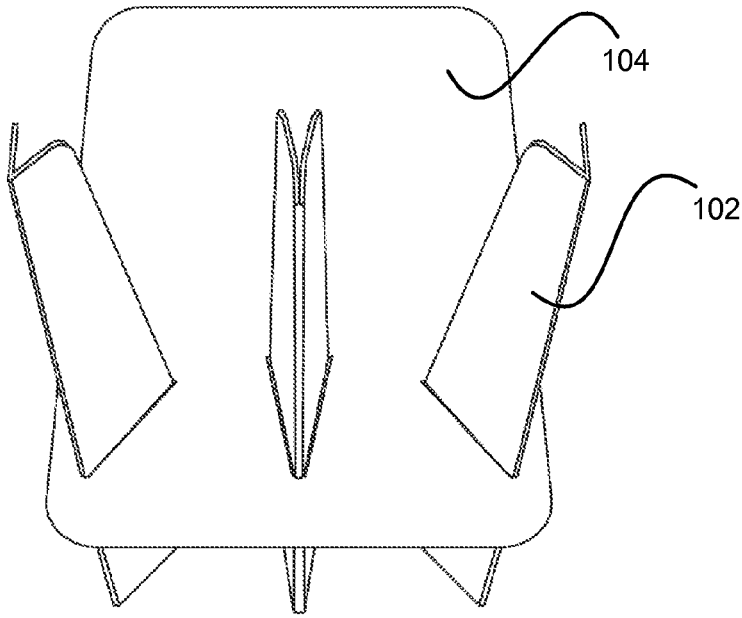

FIG. 7*b* illustrates the step 606 of the method 600. The seat bottom 104 is traversed by protrusions of the base member 102, and is slid down the protrusions to reach the weight supporting section 200 of the base member 102.

Figure 7C:
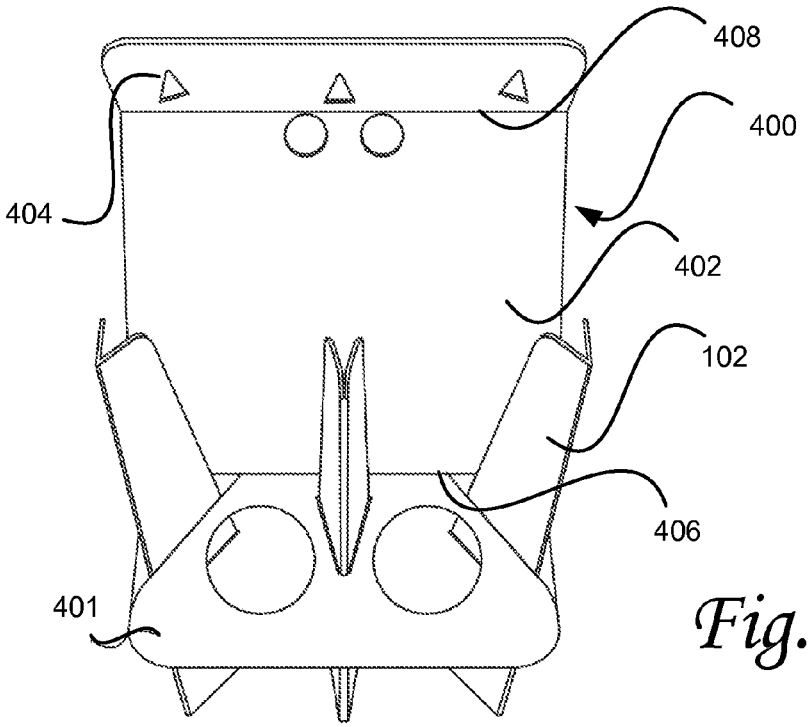

FIG. 7*c* illustrates the substeps 610, 612, and 614 of step 608 for a foldable back support member 400. The bottom portion 401 of the back support member 400 is joined to the middle protrusion of the base member 102, and is slid down the middle protrusion, until the sliding stops at a location where the cross sectional size of the middle protrusion is equal to the cross sectional size of the aperture of the bottom portion 401. Below the location the cross sectional size of the middle protrusion is larger than the cross sectional size of the aperture, preventing further sliding.

The back support member 400 is folded along a first line 406, and middle portion 402 of the back support member 400 is rotated towards the protrusion.

The back support member 400 is folded along a second line 408.

Figure 7D:
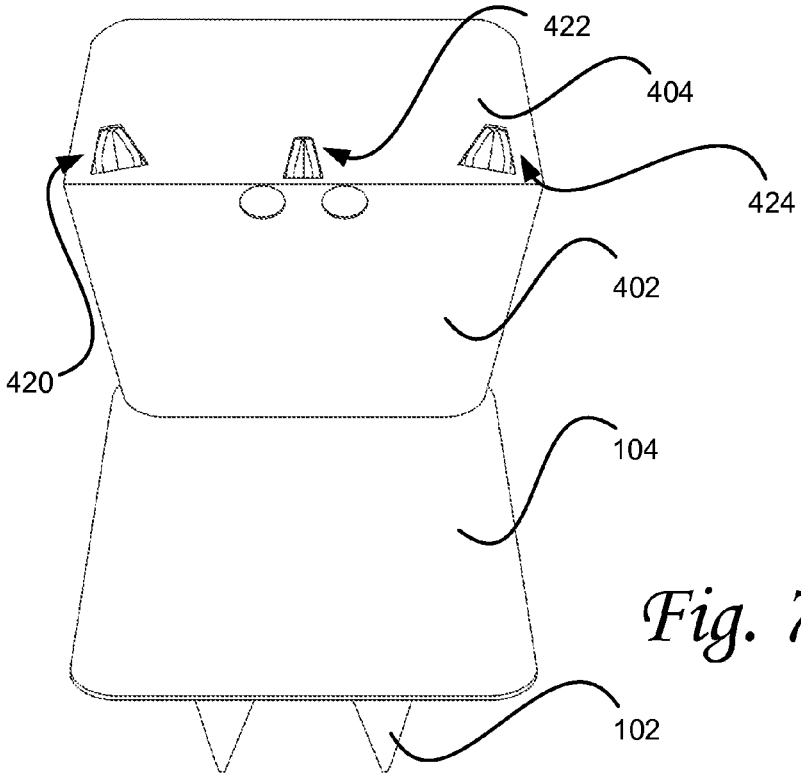

FIG. 7*d* illustrates substep 616 of step 608 for a foldable back support member 400. The top portion 404 of the back support member 400 is secured to the middle protrusion, as the middle protrusions is made to traverse the holes 422. Optionally, the left and right protrusions also traverse the holes 420 and 424 of the top portion 404, respectively.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A chair, comprising:

a flat seat bottom, having a surface area for accommodating a user;

a base member having at least one protrusion, the protrusion being configured for traversing a perforation on the seat bottom, thereby joining the base member to the bottom of the seat bottom, and the base member being configured for supporting the weight of the seat bottom and the user; and a back support member, configured for being joined to a section of the protrusion located above the seat bottom, and for being leaned upon by the user;

wherein the base member is made of a single sheet, and is configured for being set into a predefined weight bearing configuration suitable for supporting the weight of the user;

wherein the base member is configured for being unfolded into a single layer sheet or folded into a multi layer sheet, following a disassembling of the chair; and wherein the chair is repeatedly assemblable and disassemblable;

wherein the perforation of the seat bottom is configured for constraining the protrusion of the base member into a predefined shape, the predefined shape affecting the geometry of the base member;

such that the base member is constrained into the predefined weight bearing folded configuration thereof by being joined to the seat bottom.

2. The chair of claim 1:

wherein the base member has a plurality of protrusions, and the seat bottom has a plurality of perforations;

wherein each perforation is configured for being traversed by only one protrusion, and for holding tightly the protrusion;

wherein the perforations are set in a predefined pattern, such that the base member is constrained into the predefined weight bearing configuration, once each protrusion has traversed the corresponding perforation.

3. A chair, comprising:

a flat seat bottom, having a surface area for accommodating a user;

a base member having at least one protrusion, the protrusion being configured for traversing a perforation on the seat bottom, thereby joining the base member to the bottom of the seat bottom, and the base member being configured for supporting the weight of the seat bottom and the user; and a back support member, configured for being joined to a section of the protrusion located above the seat bottom, and for being leaned upon by the user;

wherein the base member is made of a single sheet, and is configured for being set into a predefined weight bearing configuration suitable for supporting the weight of the user;

wherein the base member is configured for being unfolded into a single layer sheet or folded into a multi layer sheet, following a disassembling of the chair; and wherein the chair is repeatedly assemblable and disassemblable;

wherein the base member is configured for being set into one of two weight bearing configurations:

folded along five vertical lines, such that in the base member's weight bearing configuration, a cross section of the base member along a horizontal plane is shaped like a W, with two flaps at the extremities of the W, reaching toward the middle of the W; and folded along seven vertical lines, such that in the base member's weight bearing configuration, a cross section of the base member along a horizontal plane is shaped like a W with two smaller V-shaped flaps, each flap folded within one of the halves of the W.

4. The chair of claim 3:

wherein the base member comprises three protrusions; and wherein the seat bottom has three perforations, each perforation configured for being traversed by only one of the three protrusions and for holding tightly the protrusion the perforation is traversed by;

such that the base member is constrained into the predefined weight bearing configuration by being joined to the seat bottom.

5. The chair of claim 4:

wherein the base member is initially a prefolded multilayer sheet;

wherein the base member is configured for being released into a shape that approximates the predefined weight bearing configuration; and wherein the base member is configured for assuming the predefined weight bearing configuration by being joined to the seat bottom, after having been released.

6. The chair of claim 4:

wherein the first protrusion is centered about the second fold from the rightmost edge of an expanded base member, when there are five vertical fold lines;

wherein the second protrusion is centered about the fourth fold from the rightmost edge of the unfolded base member; and wherein the third protrusion is centered about the sixth fold from the rightmost edge of the unfolded base member;

such that the protrusions rise from three wedges on the back side of the base member in the folded configuration thereof; and such that the protrusions are V-shaped when the base member is in the folded configuration thereof, with the wedges of the V's pointing away from the center of the chair.

7. The chair of claim 6, wherein the perforations of the base member are also V-shaped to accommodate the protrusions and set the dihedral angle of the protrusions.

8. The chair of claim 4, wherein the horizontal length of the protrusions diminishes as the vertical height of the protrusions rises.

9. The chair of claim 8:

wherein the back support member comprises:

a bottom portion, having at least one aperture, for being traversed by one of the protrusions;

a middle portion, configured for being folded along a first line at a first angle with respect to the bottom portion, and for being leaned on by the user; and a top portion, having at least one hole for being traversed by one of the protrusions, the top portion being configured for being folded along a second line at a second angle with respect to the middle portion, and for securing the back support member to at least one of the protrusions;

wherein the back support member is made of a single sheet and is configured for being set into a predetermined folded arrangement; and wherein the back support member is configured for being unfolded into a single layer sheet or folded into a multi layer sheet, following a disassembling of the chair.

10. The chair of claim 9:

wherein the cross sectional size of the aperture is smaller than the maximal cross sectional size of the middle protrusion, and larger than the minimal cross sectional size of the middle protrusion;

wherein the size of the aperture is chosen so that the back support member is configured for being slipped down the middle protrusion only up to a predefined location which is at a predefined distance from the seat bottom, further slippage being hindered by the larger cross sectional size of the middle protrusion below the predefined location.

11. The chair of claim 9, wherein the aperture is one of:

V-shaped; and triangular.

12. The chair of claim 9, wherein the bottom portion of the back support member has a circular orifice near the aperture, the circular orifice being configured for encircling a beverage cup placed on the seat bottom.

13. A method for assembling a chair, comprising:

providing a seat bottom, a base member, and a back support member;

setting the base member into a weight bearing configuration, suitable for supporting the weight of a user;

joining the base member to the seat bottom so that the seat bottom is positioned on top of a weight supporting section of the base member, by traversing an orifice of the seat bottom via a protrusion comprised in the base member; and joining the back support member to a section of the protrusion located above the seat bottom; and wherein the weight bearing configuration of the base member is one of the following:

folded along five vertical lines, such that in the weight bearing configuration, a cross section of the base member along a horizontal plane is shaped like a W, with two flaps at the extremities of the W, reaching toward the middle of the W; and folded along seven vertical lines, such that in the weight bearing configuration of the base member, a cross section of the base member along a horizontal plane is shaped like a W with two smaller V-shaped flaps, each flap folded within one of the larger V's forming the W.

14. The method of claim 13:

wherein the providing comprises providing a flat base member; and wherein the setting comprises folding the base member into one of:

the weight bearing configuration; and a shape approximating the weight bearing configuration.

15. The method of claim 13:

wherein the providing comprises providing the base member as a prefolded multilayer sheet; and wherein the setting comprises releasing the base member into one of:

the weight bearing configuration; and a shape approximating the weight bearing configuration.

16. The method of claim 13, wherein the joining of the back support member to the protrusion comprises:

joining a bottom portion of the back support member to the protrusion, by traversing an aperture of the bottom portion via a section of the protrusion above the seat bottom;

folding the back support member along a first predetermined line, so that a middle portion of the back support member is at a first angle with respect to the bottom portion;

folding the back support member along a second predetermined line, so that a top portion of the back support member is at a second angle with respect to the middle portion; and securing the top portion of the back support member to the protrusion, by traversing a hole of the top portion via the protrusion.

17. The method of claim 13, wherein the seat bottom, the base member, and the back support member are initially part of a single flat board, and wherein the providing comprises:

separating the seat bottom, the base member, and the back support member from the flat board.

18. The method of claim 13, wherein the base member comprises a plurality of protrusions, and the seat bottom has one orifice for each protrusion of the base member.

* * * * *